United States Patent [19]

Forkish

[11] Patent Number: 4,633,612

[45] Date of Patent: Jan. 6, 1987

[54] ANTI-BURGLAR WINDOW BARS

[76] Inventor: Robert L. Forkish, 2555 S. Sepulveda Blvd., Los Angeles, Calif. 90064

[21] Appl. No.: 784,354

[22] Filed: Oct. 4, 1985

[51] Int. Cl.[4] ..... E06B 3/68

[52] U.S. Cl. ..... 49/55

[58] Field of Search ..... 49/55, 50, 56, 61

[56] References Cited

U.S. PATENT DOCUMENTS

| | | | |
|---|---|---|---|
| 625,926 | 5/1899 | Graham | 49/55 |
| 683,217 | 9/1901 | Mower | 49/55 |
| 1,891,588 | 12/1932 | Claus | 49/55 X |
| 2,803,074 | 8/1957 | Brokish | 49/55 X |
| 3,942,576 | 3/1976 | Rickard | 49/55 X |
| 4,038,800 | 8/1977 | Daley, Jr. | 49/55 X |
| 4,149,342 | 4/1979 | Bowers | 49/55 |

FOREIGN PATENT DOCUMENTS

| | | | |
|---|---|---|---|
| 1084707 | 9/1967 | United Kingdom | 49/50 |

*Primary Examiner*—Philip C. Kannan
*Attorney, Agent, or Firm*—William H. Maxwell

[57] ABSTRACT

Anti-burglar window bars for universal installation in double hung windows wherein preferably the lower sash remains operable to be closed and opened for ventilation with the bar set by Vernier type adjustment and disposed between opposite jambs on trunnion plates fastened into the jamb channels and secured preferably by the bolt of a padlock.

5 Claims, 7 Drawing Figures

ANTI-BURGLAR WINDOW BARS

BACKGROUND

This invention prevents the burlarizing of dwellings that have windows which are required to be open for ventilation. It is the bedrooms of hotels, apartments and homes which are of particular concern, since natural ventilation by means of an open window is most often desired while persons occupying the rooms are sleeping. However, rooms other than bedrooms are also to be protected, it being a general object of this invention to provide an Anti-Burglar Window Bar that is universally adaptable to double-hung windows, wherein the upper and/or lower sash is open for ventilation.

The prior art is characterized by permanently installed bars and grids of heavy metal construction, and which are difficult and expensive to install. That is, windows are usually burgalproofed by fixtures made part of the building structure, and which are specially fitted to each window opening. It is an object of this invention to provide a hardware assembly which is readily adapted to any window opening, within a wide size range, and with a minimum use of tools, and which is locked in place to be immoveable from the window jamb. In practice, a horizontal telescoping bar is provided so as to be adjustable in length and suspended by its opposite ends by means of trunnion plates fastened into the opposite window jambs.

Double hung windows involve upper and lower sash, the upper sash which runs downward within the confines of an outer jamb channel, and the lower sash which runs upward within the confines of an inner jamb channel. It is usually the lower and inner sash which is raised to open the window, although the upper and outer sash can be lowered to do so. In any case, the window opening is sizable and inviting to the breaking and entering by a burglar. However, one or more spaced and horizontally disposed bars of the present invention make it virtually impossible for a burglar to break and enter. Furthermore, removal or destruction of the bar or bars by a burglar will be so disturbing to the room occupant that he or she may take appropriate action to deter the burglar and/or seek help. In practice, the trunnion plates are simply nailed into place, and between which the telescoping bars are adjusted and secured by means of a padlock or the like. A bolt and nut can also be used for securement, though a lock and key is preferred. A feature is the Vernier type of adjustment that is used for snugging the bars into working position.

SUMMARY OF THE INVENTION

This invention relates to a window barrier that prevents burglary. An open double hung window is an invitation to a burglary, since a burglar can silently slip through such an opening with ease, while the room occupant remains unaware of the intrusion. However, a bar spaced closely to the window sill and to the open sash makes it impossible for the burglar to enter. A small window may require a single bar assembly, while a larger window may require a plurality of bar assemblies arranged in spaced parallel relationship. The spacing of said bars from the sill and sash, and one from the other, can vary as circumstances require. The primary objective of this invention it to render entry to difficult that a would be intruder is deterred. The trunnion plates and the telescoped bar assemblies of the present invention can only be installed in such a manner that destruction of the window jambs would be necessary in order to remove or displace said bars. Adjustment of the bars to snuggly fit the window opening, jamb to jamb, is by a Vernier type means held secure by a bolt and preferably under lock and key. Any attempt to enter through a window protected by these Anti-Burglar Window Bars will cause such a disturbance that any room occupant is certain to be alerted while the burglar is being detained short of entry.

The foregoing and other various objects and features of this invention will be apparent and fully understood from the following detailed description of the typical preferred form and application thereof, throughout which description reference is made to the accompanying drawings.

THE DRAWINGS

Figure 1:
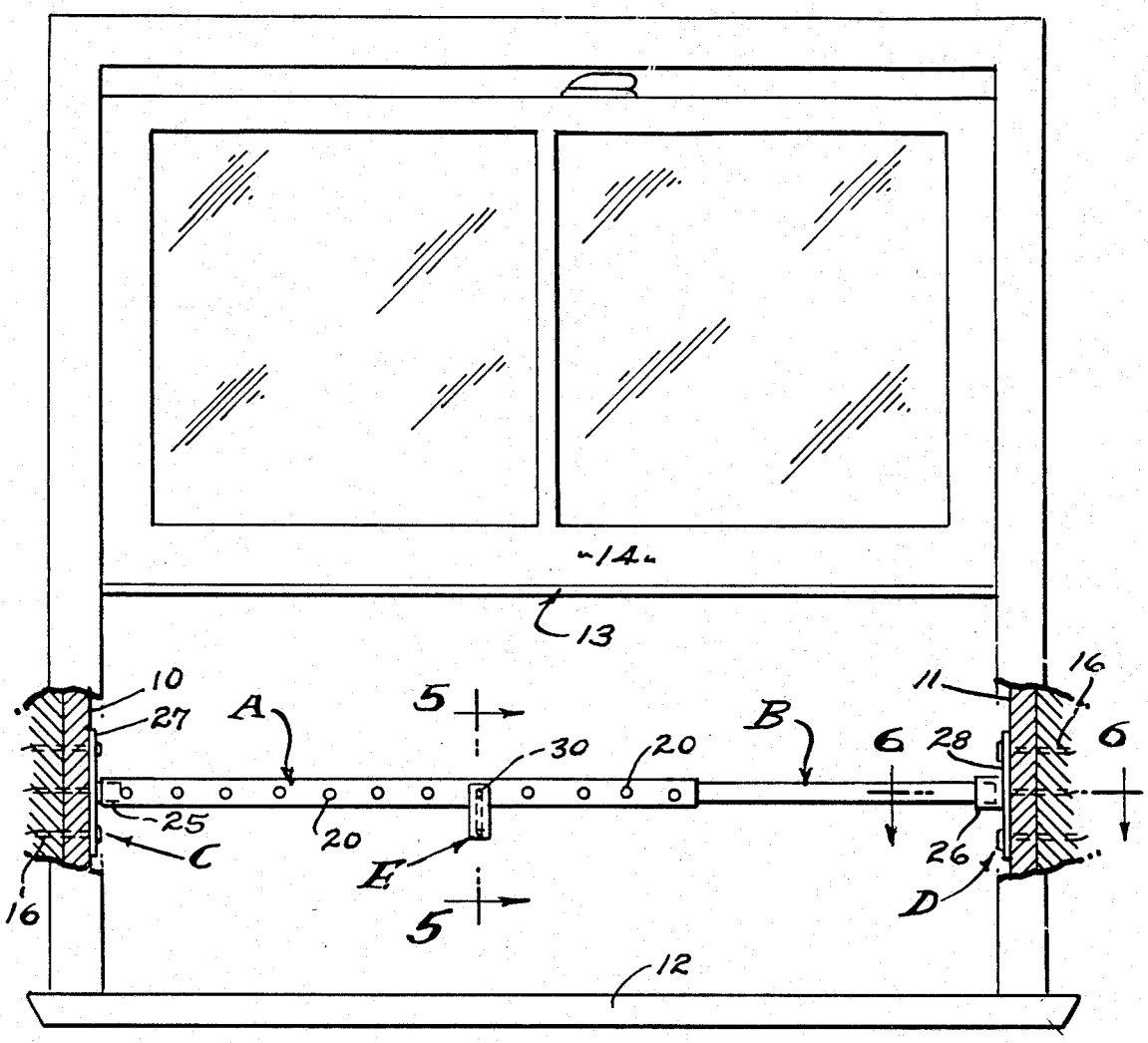
FIG. 1 is an elevational view taken from the inside of a room and showing a typical double hung window with the lower and inner sash raised a full amount, and the Anti-Burglar Window Bar fastened into the opposite side jambs at mid height of the opening.
Figure 2:
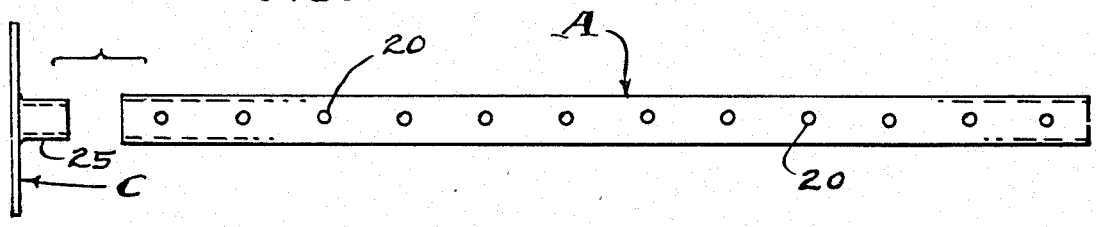
FIG. 2 is an enlarged exploded view of the left bar section and trunnion plate shown in FIG. 1.
Figure 3:
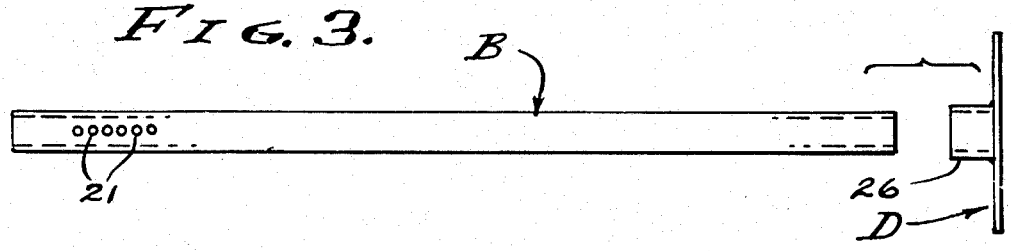
FIG. 3 is an enlarged exploded view of the right bar section and trunnion plate shown in FIG. 1.
Figure 4:
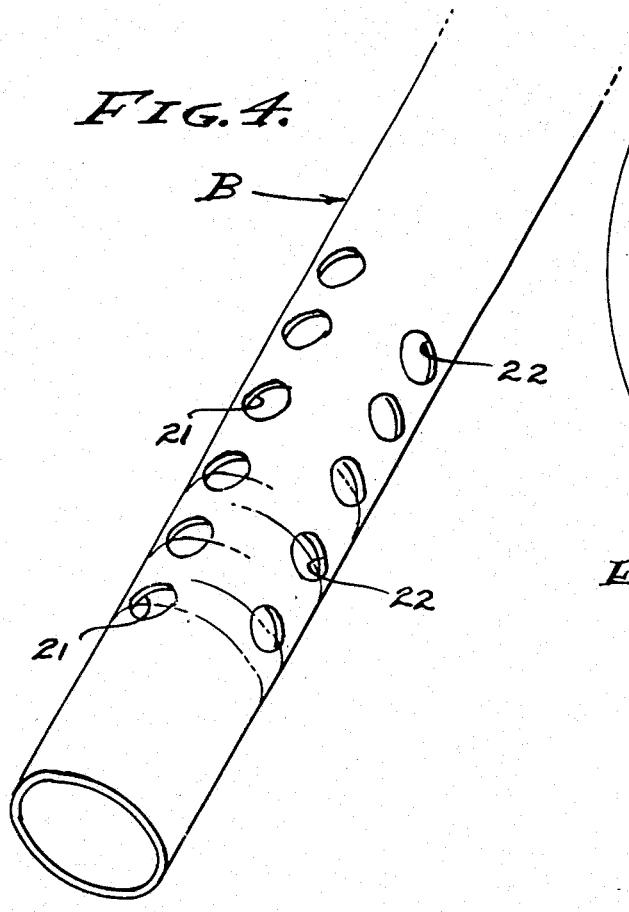
FIG. 4 is an enlarged detailed perspective view of the end portion of the right bar section shown in FIG. 3, illustrating the Vernier type adjustment feature.
Figure 5:
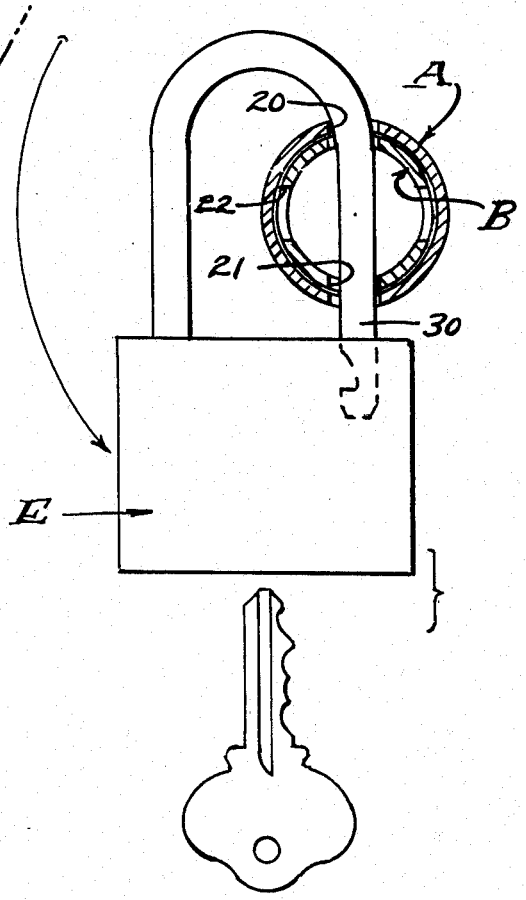
Figure 6:
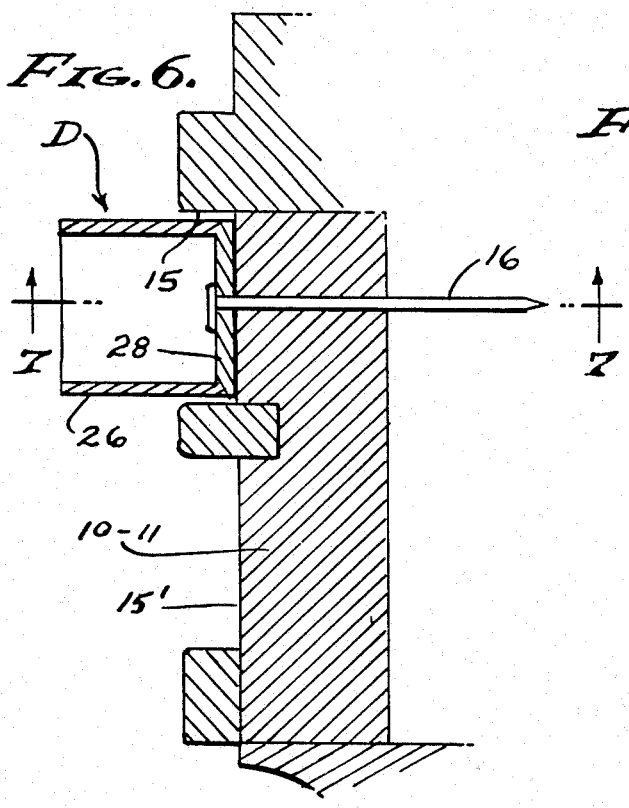
Figure 7:
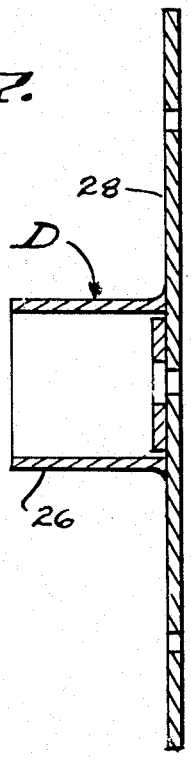

FIG. 5 is an enlarged section view taken substantially as indicated by line 5—5 on FIG. 1 and showing the locking feature rotated so as to clear the inner sash which remains operable and which ensures securement, FIG. 6 is an enlarged detailed sectional view taken as indicated by line 6—6 on FIG. 1 and showing the outer jamb channel occupied by the trunnion plate and the inner jamb channel unobstructed. And, FIG. 7 is a detailed sectional view of a mounting plate, both of which are alike, taken as indicated by line 7—7 on FIG. 6, and including a shim washer.

PREFERRED EMBODIMENT

The present invention is embodied in a hardware assembly comprised generally of telescoping bars A and B held secure between opposite trunnion plates C and D by lock means E. In practice, the assembly is of metal parts involving steel tubes and plates. The trunnion plates C and D are weldments. The bars A and B are of steel tubing or the like, the tubular bar B being slideable within the tubular bar A. In practice, and preferably for example, bar A is 1 and ⅛ outside diameter and with a 0.060 inch wall thickness, while the bar B is 1 (one) inch outside diameter and with a 0.050 inch wall thickness. Accordingly, the bars A and B freely telescope one with respect to the other. As shown, the bars A and B are straight right cylinders round in cross section, whereby the bar B rotates within the bar A. The opposite ends of the bars are cut off at right or normal angles and the ends remain open.

A practical range of window sizes for this adaptation is a two foot width to a three and one half foot width, the following bar dimensions being such as to accomodate said width range of window size. It is to be understood, however, that the bar dimensions can be changed to accomodate other ranges of width size. The length of bar A is therefore just short of two feet, so as to accomodate the thickness of the trunnion plates. And the length of bar B is therefore about 22 inches, in order to accomodate the length of the trunnion projecting from trunnion plate C.

The general construction of a double hung window to which this Anti-Burglar Window Bar is to be adapted is as follows: There are opposite side jambs 10 and 11 parallel one with the other and extending upwardly from a sill 12. The lower window sash 13 is comprised of opposite stiles slideable within the jambs 10 and 11, whereby the lower rail 14 can be raised to a position midway of the window, and spaced from the sill 12. It is to be understood that the upper window sash (not shown) can also be moved (lowered) in a similar manner with respect to the header of the window, however and as disclosed herein, the upper and outer sash remains in the UP and closed position in order to provide for the installation of the bar assembly A and B with the opposite trunnion plates C and D fastened into the outer jamb channels (see FIG. 6). Accordingly, the lower and inner sash 13 can be operated between closed and opened positions without interference from the bar assembly installation. Note particularly, therefore, that the trunnion plates C and D are installed in the outer jamb channel 15, and that the inner jamb channel 15' remains unobstructed. In practice, the trunnion plates C and D are secured by fasteners 16, for example by nails or screws as shown.

In accordance with this invention, the bar A is provided with a series of equally spaced bolt openings 20, the series being coextensive of the bar. The openings 20 extend through the bar A in the form of pairs thereof, disposed on a common axis and drilled or punched through diametrically opposite side walls of the bar. In accordance with the Vernier concept of adjustment employed herein, the series of openings is a straight series spaced for example at two inch intervals, there being twelve positions of said openings as shown. The aligned pairs of openings 20 are of a size or diameter to pass the lock bolt later described.

In accordance with this invention, the bar B is provided with a series of equally spaced bolt openings 21 and 22, the two series of openings being confined to one end portion of the bar B. The openings 21 and 22 extend through the bar B in the form of pairs thereof, disposed on right angularly related common axes in each instance drilled or punched through diametrically opposite side walls of the bar B. In accordance with the Vernier concept of adjustment employed herein, the series of openings 21 and/or 22 are more closely spaced than the openings 20 through bar A. For example, the openings 21 are spaced at one sixth of the distance between the openings 20, whereby the bar B has six adjusted positions with respect to bar A. And for example, the openings 22 are spaced the same as openings 21 but at half increment positions, there being five spaced openings 22 as shown whereby the bar B has five additional adjusted positions with respect to the bar A. With the spacing of openings herein shown and described, there are twelve adjusted positions at and between each longitudinally spaced pair of openings 20 along the bar A; which is less than two tenths of an inch between positions selected. It is a simple matter to rotate the bar B within bar A and to slide the bars into a most advantageous adjusted position, whereupon a bolt of the lock means E is inserted transversely through the bars A and B.

The trunnion plates C and D are alike and differ only with respect to the reasonably tight reception of the bars A and B of different diameter. Trunnion plate C that receives and supports the end of bar A has a trunnion 25 made of the same tubing as that of bar B and which slides into the open end of the bar A. Trunnion plate D that receives and supports the end of the bar B has a trunnion 26 made of the same tubing as that of bar A and which slides over the open end of the bar B. The trunnion 25 is welded or otherwise secured to a plate 27, while the trunnion 26 is welded or otherwise secured to a plate 28. The plates 27 and 28 are alike and each is shaped so as to fit into a jamb channel 15 or channel 15', where it is fastened with the trunnions 25 and 26 in horizontal alignment. The plates 27 and 28 are flat with openings therethrough to pass fasteners into the jambs 10 and 11.

From the foregoing it will be apparent how the bars A and B are telescopically related and then extended so as to simultaneously fit over and into the trunnion 25 and 26, whereupon adjustment is made to a maximum length and a bolt 30 is inserted through opposite pairs of aligned openings through the bars, as hereinabove described. A key operated padlock having a bolt 30 leg is perferably employed for securment, as shown in FIG. 5. Burglar ingress is made impossible by installing one or more Anti-Burglar Window Bars as it is shown and described, adjustment for a tight installation being by insertion of a cut washers, or the like used as a shim.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. An anti-burglar window bar for installation in a double hung window having inner and outer side jamb channels in opposite side jambs and having a sash slideable in each of said inner and outer channels and one sash moveable to overlie the other sash and leaving a window opening between the side jambs, and including;

a trunnion plate secured into each of the opposite side jamb channels of the other sash and each with a trunnion in horizontal alignment with the other across the window opening, a pair of telescoping bars and each with an end received and supported by a trunnion plate trunnion, one bar having a coextensive series of longitudinally spaced adjustment openings extending therealong in equally spaced increments, and the other bar having a series of adjustment openings confined to the end portion thereof, the series of adjustment openings confined to the end portion of the other bar being more closely spaced than the equal spacing of the adjustment openings in the first mentioned one bar, one adjustment opening of one bar being alignable with one adjustment opening of the other bar when said pars are extended between the trunnion plates and supported by the trunnions thereof, and a securement bolt passed through the aligned adjustment openings of the supported bars.

2. The anti-burglar window bar as set forth in claim 1, wherein the series of adjustment openings confined to the end portion of said other bar extends a distance substantially equal to the equal spacing of the adjustment openings in the first mentioned one bar.

3. The anti-burglar window bar as set forth in claim 1, wherein the one bar is an outer telescoping cylindrical member with the adjustment openings aligned through opposite side walls thereof, and wherein the other bar is rotatable within the first mentioned one bar and has the series of adjustment openings.

4. The anti-burglar window bar as set forth in claim 1, wherein the one bar has an outer telescoping cylindrical member with the adjustment openings aligned through opposite side walls thereof, and wherein the other bar is rotatable within the first mentioned one bar and has two right angularly related series of adjustment openings confined to an end portion thereof, each series extending a distance substantially equal to the spacing of the adjustment openings in the first mentioned one bar, and one series having its adjustment openings at half increments with respect to the adjustment openings of the other series, one bar member being rotatable with respect to the other for alignment of the angularly related series of adjustment openings with the adjustment openings of the first mentioned one bar.

5. The anti-burglar window bar as set forth in claim 1, wherein the securement bolt is the bolt of a key operated padlock.

* * * * *